US008486251B2

(12) United States Patent
Koveal

(10) Patent No.: US 8,486,251 B2
(45) Date of Patent: Jul. 16, 2013

(54) PROCESS FOR REGENERATING ALKALI METAL HYDROXIDES BY ELECTROCHEMICAL MEANS

(75) Inventor: Russell J. Koveal, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 901 days.

(21) Appl. No.: 12/460,832

(22) Filed: Jul. 24, 2009

(65) Prior Publication Data

US 2010/0187124 A1 Jul. 29, 2010

Related U.S. Application Data

(60) Provisional application No. 61/137,973, filed on Aug. 5, 2008.

(51) Int. Cl.
*C25B 5/00* (2006.01)

(52) U.S. Cl.
USPC ..... 205/347; 205/617; 205/639; 205/494

(58) Field of Classification Search
USPC ..... 205/347, 617, 639, 494
See application file for complete search history.

(56) References Cited

U.S. PATENT DOCUMENTS

| | | | | |
|---|---|---|---|---|
| 1,642,624 | A | 9/1927 | Northrup | |
| 1,998,849 | A | 4/1935 | Schulze | |
| 2,504,058 | A | 4/1950 | Unschuld et al. | |
| 3,249,522 | A * | 5/1966 | Bolmer | 205/343 |
| 3,409,520 | A | 11/1968 | Bolmer | |
| 3,546,105 | A | 12/1970 | Jaffe | |
| 3,788,978 | A | 1/1974 | Bearden, Jr. et al. | |
| 3,915,819 | A | 10/1975 | Bell et al. | |
| 4,043,881 | A | 8/1977 | Yen et al. | |
| 4,043,885 | A | 8/1977 | Yen et al. | |
| 4,045,313 | A | 8/1977 | Yen et al. | |
| 4,066,739 | A | 1/1978 | Chen | |
| 4,081,337 | A | 3/1978 | Spitzer | |
| 4,204,923 | A | 5/1980 | Carpenter | |

(Continued)

FOREIGN PATENT DOCUMENTS

CN 1699519 A 11/2005

OTHER PUBLICATIONS

Aitani, A.M.; Ali, M.F.; Al-Ali, H.H.;"A Review of Non-Conventional Methods for the Desulfurization of Residual Fuel Oil," Petroleum Science and Technology, 18(5&6), 537-553 (2000).

(Continued)

*Primary Examiner* — Harry D Wilkins, III
*Assistant Examiner* — Zulmariam Mendez
(74) *Attorney, Agent, or Firm* — Bruce M. Bordelon

(57) ABSTRACT

This invention relates to the desulfurization of a hydrocarbon feedstock by contacting said feedstock with an aqueous metal hydroxide solution, thus resulting in a desulfurized feedstock and an aqueous metal sulfide stream. In the present invention, the aqueous metal sulfide stream is split into at least three fractions and each fraction is passed to a different electrochemical cell, connected in series to regenerate the metal hydroxide required in the desulfurization process and recover sulfur, metal hydroxide, and hydrogen. In a preferred embodiment, at least a portion of the metal hydroxide that is produced in the electrochemical metal hydroxide regeneration process of the present invention is recycled for use in the process for desulfurizing the sulfur-containing hydrocarbon feedstock.

23 Claims, 1 Drawing Sheet

U.S. PATENT DOCUMENTS

| | | | | |
|---|---|---|---|---|
| 4,260,394 | A | | 4/1981 | Rich |
| 4,362,610 | A | | 12/1982 | Carpenter |
| 4,371,507 | A | | 2/1983 | Farha, Jr. et al. |
| 4,849,094 | A | | 7/1989 | Shmeleva et al. |
| 4,920,015 | A | | 4/1990 | Sammells |
| 4,954,229 | A | | 9/1990 | Kim et al. |
| 5,310,465 | A | * | 5/1994 | Vaughan ..... 205/750 |
| 5,391,278 | A | | 2/1995 | Honna et al. |
| 5,514,252 | A | | 5/1996 | Kerby, Jr. et al. |
| 5,578,189 | A | | 11/1996 | Joshi |
| 5,879,529 | A | | 3/1999 | Greaney et al. |
| 5,935,421 | A | | 8/1999 | Brons et al. |
| 6,132,590 | A | | 10/2000 | Moran et al. |
| 6,238,530 | B1 | | 5/2001 | Yoshida et al. |
| 6,241,871 | B1 | | 6/2001 | Donini et al. |
| 6,274,026 | B1 | | 8/2001 | Schucker et al. |
| 6,338,788 | B1 | | 1/2002 | Schucker |
| 6,368,495 | B1 | | 4/2002 | Kocal et al. |
| 6,402,940 | B1 | | 6/2002 | Rappas |
| 6,497,973 | B1 | | 12/2002 | Amendola |
| 6,824,673 | B1 | | 11/2004 | Ellis et al. |
| 6,877,556 | B2 | | 4/2005 | Wittle et al. |
| 7,244,351 | B2 | | 7/2007 | Baez et al. |
| 2003/0102123 | A1 | | 6/2003 | Wittle et al. |
| 2005/0161217 | A1 | | 7/2005 | Wittle et al. |
| 2006/0102523 | A1 | | 5/2006 | Baez et al. |
| 2006/0254930 | A1 | | 11/2006 | Martinie et al. |
| 2007/0108101 | A1 | | 5/2007 | Baez et al. |
| 2007/0175798 | A1 | | 8/2007 | Fokema et al. |
| 2009/0145806 | A1 | | 6/2009 | Hamad |

OTHER PUBLICATIONS

Ovalles, C.; Rojas, I.; Acevedo, S.; Escobar, G.; Jorge, G.; Gutierrez, L.B.; Rincon, AL.; Scharifker, B.; "Upgrading of Orinoco Belt crude oil and its fractions by an electrochemical system in the presence of protonating agents," Fuel Processing Technology 48 (1996) 159-172.

N. Ignat'ev et al., New Ionic Liquids with Tris(Perfluoroalkyl)Trifluorophosphate (FAP) Anions, 126 J. Fluorine Chem., 1150-1159 (2005).

B. Sunderland, "Impact of Future Fuel Specifications on Bitumen Upgrading", Proceedings of the World Petroleum Congress, 2000, 16th, vol. 3, pp. 70-77.

K. G. Knudsen, et al., "Catalyst and Process Technologies for Ultra Low Sulfur Diesel", Applied Catalysis A: General, 1999, vol. 189, pp. 205-215.

S. G. Mossner, et al., "Determination of Polycyclic Aromatic Sulfur Heterocycles in Fossil Fuel—Related Samples", Anal. Chem., 1999, pp. 58-69.

* cited by examiner

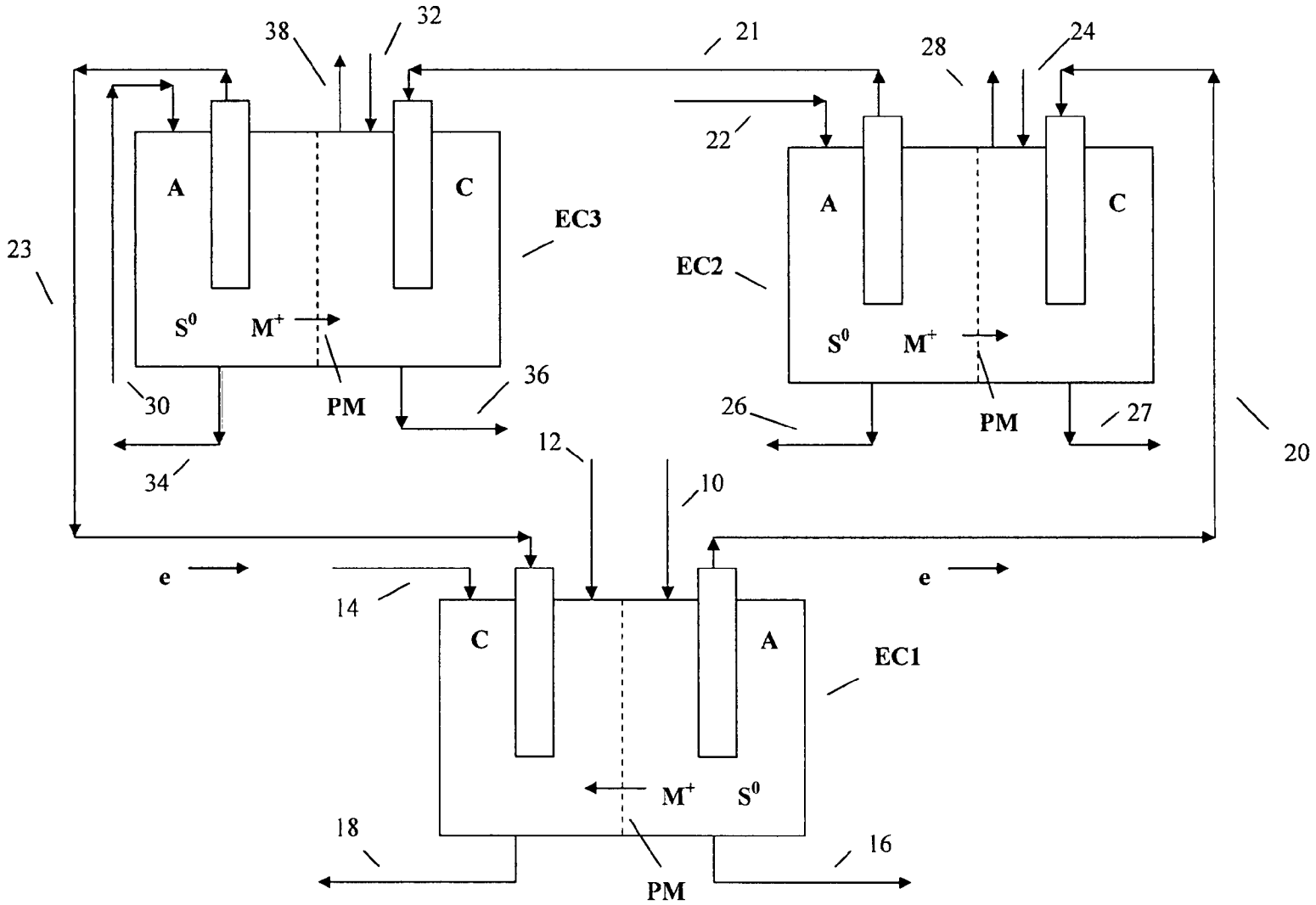
20
24
C
27
28
PM
M+
S0
A
21
22
EC2
26
EC1
16
10
12
EC3
36
32
38
30
34
14
18
23
e

PROCESS FOR REGENERATING ALKALI METAL HYDROXIDES BY ELECTROCHEMICAL MEANS

CROSS-REFERENCE TO RELATED APPLICATIONS

This application claims priority to U.S. Provisional Application Ser. No. 61/137,973 filed Aug. 5, 2008, herein incorporated by reference in its entirety.

FIELD OF THE INVENTION

This invention relates to the desulfurization of a hydrocarbon feedstock by contacting said feedstock with an aqueous metal hydroxide solution, thus resulting in a desulfurized feedstock and an aqueous metal sulfide stream. In the present invention, the aqueous metal sulfide stream is split into at least three fractions and each fraction is passed to a different electrochemical cell, connected in series to regenerate the metal hydroxide required in the desulfurization process and producing elemental sulfur as a by-product.

BACKGROUND OF THE INVENTION

As the demand for hydrocarbon-based fuels has increased, the need for improved processes for desulfurizing hydrocarbon feedstocks of heavier molecular weight has increased as well as the need for increasing the conversion of the heavy portions of these feedstocks into more valuable, lighter fuel products. These heavier, "challenged" feedstocks include, but are not limited to, low API gravity, high sulfur, high viscosity crudes from such areas of the world as Canada, the Middle East, Mexico, Venezuela, and Russia, as well as less conventional refinery and petrochemical feedstocks derived from such sources as tar sands bitumen, coal, and oil shale. These heavier crudes and derived crude feedstocks contain a significant amount of heavy, high molecular weight hydrocarbons. A considerable amount of the hydrocarbon of these heavy oil streams are often in the form of large multi-ring hydrocarbon molecules and/or a conglomerated association of large molecules containing a large portion of the sulfur, nitrogen and metals in the hydrocarbon stream. A significant portion of the sulfur contained in these heavy oils is in the form of heteroatoms in polycyclic aromatic molecules, comprised of sulfur compounds such as dibenzothiophenes, from which the sulfur is difficult to remove.

The high molecular weight, large multi-ring aromatic hydrocarbon molecules or associated heteroatom-containing (e.g., S, N, O) multi-ring hydrocarbon molecules in the higher molecular weight oils are generally found in a solubility class of molecules termed as asphaltenes. A significant portion of the sulfur is contained within the structure of these asphaltenes or lower molecular weight polar molecules termed as "polars" or "resins". Due to the large aromatic structures of the asphaltenes, the contained sulfur can be refractory in nature and is not very susceptible to removal by conventional alkali salt solution complexes such as potassium hydroxide or sodium hydroxide solution treatments under conventional operating conditions. Other intermediate refinery crude fractions, such as atmospheric resids, vacuum resids, and other similar intermediate feedstreams containing boiling point materials above about 850° F. (454° C.) contain similar sulfur polycyclic heteroatom complexes and are also difficult to desulfurize by conventional methods. These heavy crudes, derived refinery feedstocks, and heavy residual intermediate hydrocarbon streams can contain significant amounts of sulfur. Sulfur contents of in excess of 3 to 5 wt % are not uncommon for these streams and can often be concentrated to higher contents in the refinery heavy residual streams.

These high sulfur content hydrocarbon streams can be excessively corrosive to equipment in refinery and petrochemical production and/or exceed environmental limitations for use in processes such petroleum refining processes. If a significant amount of the sulfur is not removed from these feedstocks prior to refining, significant costs in capital equipment may be required to process these corrosive crudes and the sulfur is generally still required to be removed by subsequent processes in order to meet intermediate and final product sulfur specifications. Additionally, most conventional catalytic refining and petrochemical processes cannot be used on these heavy feedstocks and intermediates due to their use of fixed bed catalyst systems and the tendency of these heavy hydrocarbons to produce excessive coking and deactivation of the catalyst systems when in contact with such feedstreams. Also, due to the excessive hydrocarbon unsaturation and cracking of carbon-to-carbon bonds experienced in these processes, significant amounts of hydrogen are required to treat asphaltene containing feeds. The high consumption of hydrogen, which is a very costly treating agent, in these processes results in significant costs associated with the conventional catalytic hydrotreating of heavy oils for sulfur removal.

Due to their high sulfur content, high viscosities, and low API gravities, these heavy hydrocarbon feedstreams cannot be readily transported over existing pipeline systems and are often severely discounted for use as a feedstock for producing higher value products. Another alternative utilized is to make these heavy oils suitable for pipeline transportation or petrochemical feed only after significant dilution of the heavy oil with expensive, lower sulfur hydrocarbon diluents.

As a result, many process methods have been utilized in the art to desulfurize the very "heavy" or "high molecular weight" hydrocarbon containing streams. Due to the problems discussed with the use of fixed bed catalyst systems for use in desulfurizing these heavy hydrocarbon streams, alkali metal hydroxides have been used in aqueous solutions and contacted with the heavy hydrocarbon stream under specific conditions resulting in the formation of a desulfurized hydrocarbon product wherein a portion of the sulfur has been removed from the heavy hydrocarbon stream and a spent alkali metal hydroxide. Herein, the spent metal hydroxide is most predominantly in the forms of an alkali metal sulfide and/or alkali metal hydrosulfide.

A significant drawback to the alkali metal hydroxide desulfurization process of the art is that the alkali metal hydroxides that are spent in the processes (i.e., either in the form of a sulfide or hydrosulfide) are not easily converted back into their active hydroxide forms. In most conventional processes for alkali metal regeneration, the alkali metals sulfides are typically steam stripped, removing the sulfur from the alkali metal compounds by forming hydrogen sulfide. Not only is this stripping process typically inefficient and costly, but it also results in the formation of hydrogen sulfide ($H_2S$) which in turn must also under go an additional costly process for removal of the elemental sulfur, such as a typical Claus process. Besides requiring additional equipment and expenses, the use of steam stripping and subsequent Claus processing results in much of the hydrogen fraction of any hydrogen supplied to the hydrocarbon desulfurization process being lost as water in the $H_2S$ disposal process.

Therefore, there exists in the industry a need for an improved process for removing sulfur from bitumens, heavy crudes, derived crudes and refinery residual streams utilizing a metal hydroxide and a regenerating the spent metal hydroxide compounds for reuse in the desulfurization process.

SUMMARY OF THE INVENTION

In one embodiment in accordance with the present invention there is provided a process for recovering sulfur and generating hydrogen from a feedstream comprised of an aqueous solution of a metal sulfide, which process comprises:

a) providing at least a first electrochemical cell, a second electrochemical cell, and a third electrochemical cell, all connected in series;

b) dividing the feedstream into at least three fractions;

c) introducing a first fraction of said feedstream into said first electrochemical cell along with an effective amount of water and an effective amount of oxygen resulting in the generation of elemental sulfur and a metal hydroxide, and generating a first electrical potential across said first electrochemical cell;

d) removing at least a portion of said elemental sulfur and said metal hydroxide from said first electrochemical cell;

e) passing electrons from the anode of said first electrochemical cell to the cathode of said second electrochemical cell to generate a second electrical potential across said second electrochemical cell;

f) introducing a second fraction of said feedstream to said second electrochemical cell along with an effective amount of water resulting in the generation of elemental sulfur, a metal hydroxide, and hydrogen;

g) removing at least a portion of said elemental sulfur and said metal hydroxide and hydrogen from said second electrochemical cell;

h) passing electrons from the anode of said second electrochemical cell to the cathode of said third electrochemical cell to generate a third electrical potential across said third electrochemical cell;

i) introducing a third fraction of said feedstream into said third electrochemical cell along with an effective amount of water resulting in the generation of elemental sulfur, a metal hydroxide, and hydrogen;

j) removing at least a portion of said elemental sulfur, said metal hydroxide, and hydrogen from said third electrochemical cell; and k) passing electrons from the anode of said third electrochemical cell to the cathode of at least one other electrochemical cell;

wherein an electrical circuit around all of the electrochemical cells is completed with the first electrochemical cell.

In a preferred embodiments, the metal hydroxide is selected from an alkali hydroxide, an alkaline-earth metal hydroxide, or a combination thereof.

Also in accordance with the present invention is a process for desulfurizing a sulfur-containing heavy-oil feedstock comprising:

a) contacting said heavy-oil feedstock with an aqueous metal hydroxide solution wherein the metal is selected from the alkali metals and the alkaline-earth metals, thereby converting at least a portion of the metal hydroxides into metal sulfides;

b) separating the mixture from step a) into a desulfurized heavy-oil product and an aqueous metal sulfide-containing stream wherein the desulfurized heavy-oil product has a lower sulfur content by wt % than said heavy-oil feedstock;

c) providing at least a first electrochemical cell, a second electrochemical cell, and a third electrochemical cell, all connected in series;

d) dividing the aqueous metal sulfide-containing stream into at least three fractions;

e) introducing a first fraction of said aqueous metal sulfide-containing stream into said first electrochemical cell along with an effective amount of water and an effective amount of oxygen resulting in the generation of elemental sulfur and a metal hydroxide, and generating a first electrical potential across said first electrochemical cell;

f) removing at least a portion of said elemental sulfur and said metal hydroxide from said first electrochemical cell;

g) passing electrons from the anode of said first electrochemical cell to the cathode of said second electrochemical cell to generate a second electrical potential across said second electrochemical cell;

h) introducing a second fraction of said aqueous metal sulfide-containing stream to said second electrochemical cell along with an effective amount of water resulting in the generation of elemental sulfur, a metal hydroxide, and hydrogen;

i) removing at least a portion of said elemental sulfur and said metal hydroxide and hydrogen from said second electrochemical cell;

j) passing electrons from the anode of said second electrochemical cell to the cathode of said third electrochemical cell to generate a third electrical potential across said third electrochemical cell;

k) introducing a third fraction of said aqueous metal sulfide-containing stream into said third electrochemical cell along with an effective amount of water resulting in the generation of elemental sulfur, a metal hydroxide, and hydrogen;

l) removing at least a portion of said elemental sulfur, said metal hydroxide, and hydrogen from said third electrochemical cell; and m) passing electrons from the anode of said third electrochemical cell to the cathode of at least one other electrochemical cell;

wherein an electrical circuit around all of the electrochemical cells is completed with the first electrochemical cell.

BRIEF DESCRIPTION OF THE FIGURE

The FIGURE herein is a simplified diagram of the electrochemical system of the present invention wherein an aqueous metal sulfide solution is split into three fractions and each fraction is sent to a separate electrochemical cell wherein all three cells are connected in series. This results in the generation of elemental sulfur, hydrogen, and the hydroxide of the metal of the aqueous metal sulfide solution.

DETAILED DESCRIPTION OF THE INVENTION

The process of the present invention, in its broadest sense, relates to treating an aqueous stream having one or more metal sulfides dissolved therein. Preferred metals of the metal sulfide are the alkali and alkaline-earth metals with the alkali metals being more preferred and sodium being most preferred. Although the aqueous metal sulfide stream can be from any source, it is preferred that it be a stream resulting from the caustic treatment of sulfur-containing hydrocarbon feedstreams, and most preferably the aqueous metal sulfide stream is a resulting from the caustic treatment of sulfur-containing heavy oil feedstreams. As utilized herein, the terms "hydrocarbon feedstream", "hydrocarbon feedstream, and "hydrocarbon-containing feedstream" are considered equivalents and defined herein as any stream containing at least 75 wt % hydrocarbons. The terms "heavy oil" and "heavy oil feedstream" as used herein are considered equivalents and are defined herein as a hydrocarbon-containing feedstream having at least about 10 wt % of hydrocarbon material boiling in excess of about 1050° F. In more preferred embodiments of the present invention, the heavy oil feedstream to be treated has at least about 25 wt % of hydrocarbon material boiling above about 1050° F. Non-limiting examples of such heavy oil feedstreams include, but are not limited to, whole, topped or froth-treated bitumens; heavy oils; whole or topped crude oils; and residua. These feedstreams include crude oils obtained from any area of the world, as well as heavy gas oils, oils derived from shale, bitumens obtained from tar sands, syncrude derived from tar sands, coal oils, asphaltenes, and mixtures thereof. Additionally, both atmospheric residuum (boiling above about 650° F.) and vacuum residuum (boiling above about 1050° F.) may considered as heavy oils as utilized in the present invention. The preferred feedstream to be treated in accordance with the present invention is bitumens. Such heavy oil feedstreams also typically contain an appreciable amount of so-called "hard" or "refractory" sulfur such as dibenzothiophenes (DBTs) that are very difficult to remove by conventional means. In preferred embodiments of the present invention, the heavy oil feedstream to be treated has a sulfur content of at least 3 wt %, even more preferably, at least 5 wt %.

The aqueous metal sulfide stream will typically result from desulfurizing and upgrading heavy oil by treatment with a metal hydroxide, preferably in the presence of hydrogen. Effective conditions for desulfurization and upgrading of heavy oil using a metal hydroxide include temperatures in the range of about 150° F. to about 500° F., preferably from about 200° F. to about 400° F., and pressures in the range of about 15 psia to about 800 psia, and reaction times from about 0.1 to about 10 hours. A molar ratio of hydroxide to total sulfur (as "S") in the feed of about 0.5 to about 5 is preferred, although lesser or greater amounts of hydroxide may also be effective. The metal hydroxide is effective in removing a substantial fraction of the sulfur from the heavy oil while also reducing its viscosity, density, and the fraction boiling above about 1050° F. Hydrogen, which is optional, but preferred, in the desulfurization process, is effective in attaining greater reduction of viscosity, density, and fraction boiling above about 1050° F. than can be achieved by treatment with metal hydroxide alone.

As a result of the reaction with the sulfur contained in the heavy oil, the metal hydroxide is converted to metal sulfide and metal hydrosulfide. It is one object of this invention to provide a means to recover and regenerate the metal hydroxide from the resulting metal sulfide or metal hydrosulfide. It is also an object of this invention to provide a means for the generation of hydrogen as a result of the recovery and regeneration of the metal hydroxide. It will be understood that the term "metal sulfide", as used herein, for simplicity purposes also includes metal hydrosulfides. It is a further object of this invention to provide a means for the conversion of at least a portion of the metal sulfide or hydrosulfide to elemental sulfur. In a preferred embodiment of the present invention, at least about 50 wt % of the combined metal sulfides and hydrosulfides are converted in the electrochemical cells of the present invention to metal hydroxides.

This invention is better understood with reference to the sole FIGURE herein. Although the present invention can be utilized with more than three electrochemical cells with such modifications as would obvious to one of skill in the art, the present invention is illustrated herein using a three cell configuration. The FIGURE shows a system comprised of three divided electrochemical cells EC1, EC2, and EC3. The electrochemical cells are connected in series. It is preferred that each electrochemical cell be divided with a cation permeable membrane PM. Any cation permeable membrane can be used to separate the compartments of the electrochemical cells. These cation permeable membranes typically have fixed negative charges distributed in a polymer matrix and are permeable to positively charged ions. The membranes can be membranes of hydrocarbon and halocarbon polymers containing acid and acid derivative functional groups. Particularly suitable acid polymers are perhalocarbon polymers containing sulfonic, sulfoamide and carboxylic acid groups. The membranes may be a multi-layered structure of different polymers and contain fillers, reinforcements and chemical modifiers. The preferred membranes are substantially chemically stable to process conditions and mechanically suitable for design and economical operation of the instant electrochemical process.

The feed to the electrochemical cells of this invention will be a by-product aqueous stream comprised of metal sulfides, metal hydrosulfides, or both (i.e., the "aqueous metal sulfide stream"). Preferably, this aqueous metal sulfide stream results from the treatment of a hydrocarbon feedstream or heavy oil feedstream with a metal hydroxide to remove sulfur. Preferably, the metal is an alkali metal or an alkali-earth metal. Although the present invention is not so limited, in a preferred embodiment, the metal hydroxide is sodium hydroxide, while in another preferred embodiment, the metal hydroxide is potassium hydroxide. The metal hydroxide may also be comprised of a combination of different metal hydroxides, including, but not limited to, a combination of sodium hydroxide and potassium hydroxide. The desulfurized heavy oil stream that has been treated with aqueous metal hydroxides is collected and at least a portion of the resulting aqueous metal sulfide stream is divided into three fractions. Although not required, preferably, the aqueous metal sulfide waste stream is divided into three substantially equal fractions. By substantially equal it is meant that the no one of the flow rates of the three streams to the individual cells as illustrated deviates from the average fractional flow rate of the overall aqueous metal sulfide stream by more than about 25 vol %.

Continuing with the FIGURE, a first fraction of the aqueous metal sulfide stream is passed, via line 10, to the anode (A) side of first electrochemical cell EC1. An "effective amount of oxygen" is introduced into the cathode (C) side of said electrochemical cell via line 12. By "effective amount of oxygen" it is meant herein at least that minimum amount needed to power the cell system and to provide at least a stoichiometric amount of oxygen, wherein the stoichiometric amount of oxygen, as $O_2$, is one-half the molar rate of molar rate of sulfur as S fed to the individual cell. The oxygen may be provided via a purified oxygen source or may be provided via an oxygen-containing source such as, but not limited to, air. Water is added, via line 14, to the cathode side of first electrochemical cell EC1 in an amount needed as make-up water for the water consumed during the reduction of oxygen to hydroxide. The net overall reaction occurring on the cathode side of the cell is:

$$\tfrac{1}{2}O_2+H_2O+2e^-\rightarrow 2OH^-$$

and at the anode side:

$$S^{-2}\rightarrow S+2e^-$$

wherein it is understood that the above reactions are a simplification of a complex series of reactions that result in the transformation of the reactants into the products. Furthermore, it is well-known that elemental sulfur exists as an octamer ($S_8$) at typical processing conditions, but it is shown herein as a monomeric species for convenience. The above reactions occur at or near the surface of the respective electrodes. As is known in the art, the electrodes can be optimized by constructing them of catalytic or non-catalytic materials that favor the above reactions.

The metal sulfide, preferably an alkali metal sulfide, undergoes an oxidation reaction at the anode side of electrochemical cell EC1 wherein metal cations $M^+$ and elemental sulfur $S^0$ are produced. Electrons are generated and collect at the anode and pass via electrically conductive line 20 to the cathode of second electrochemical cell EC2. The metal cations ($M^+$) permeate through the cation permeable membrane PM where they balance the negative charge of the hydroxide ion that is produced at the cathode side, thus regenerating the metal hydroxide (MOH), which is removed from the cell via line 18. At least a portion of the elemental sulfur is removed via line 16.

For purposes of the example, a "unit voltage" is generated in EC1 and enough power is typically generated to drive electrochemical cells EC2 and EC3 by a flow of electrons from the anode side of first electrochemical cell EC1 along electrically conductive line 20 to the cathode of second electrochemical cell EC2. In a preferred embodiment of the present invention the unit voltage is preferably from about 0.5 to about 10 volts, more preferably from about 0.5 to 5 volts. The second fraction of the aqueous metal sulfide stream is introduced into the anode side of the second electrochemical cell EC2 via line 22 and water is introduced via line 24. Preferably, the amount of water introduced is about twice the molar amount of sulfide fed to the cell. The metal sulfide undergoes an oxidation reaction at the anode, as in electrochemical cell EC1, which results again in metal cations $M^+$ that permeate through cation permeable membrane PM and elemental sulfur $S^0$ which is collected via line 26. The permeating metal cations balance the negative charge of the hydroxide that is produced on the cathode side of the cell, thus regenerating the metal hydroxide (MOH), which is removed via line 27. Excess hydrogen produced by the reduction of water at the cathode side of second electrochemical cell EC2 is removed via line 28. In this configuration, a portion of the power generated in the first electrochemical cell EC1 provides the electrical power for the second electrochemical cell EC2. In this configuration, a portion of the power generated in the first electrochemical cell EC1 also provides the electrical power for the third electrochemical cell EC3 via the transport of electrons via electrically conductive line 21 from the anode of electrochemical cell EC2 to the cathode of electrochemical cell EC3.

In this configuration, the third fraction of the aqueous metal sulfide stream is introduced into the anode side of third electrochemical cell EC3 via line 30 and an effective amount of water via line 32. Again, the metal sulfide undergoes an oxidation reaction that produces metal cations $M^+$ and elemental sulfur $S^0$. The elemental sulfur is collected via line 34 and the metal cations permeate through membrane PM of the third electrochemical cell EC3 wherein the metal cations combine with hydroxide ions to regenerate additional metal hydroxide (MOH), which is collected via line 36. The overall electrical loop is closed with a transfer of electrons via electrically conductive line 23 from the anode of electrochemical cell EC3 to the cathode of electrochemical cell EC1. Excess hydrogen produced in the cathode side of electrochemical cell EC3 is collected via line 38.

As shown in the FIGURE hereof, the electrical potential generated in the first cell is ideally sufficient to drive the hydroxide regeneration reactions in all three cells. In the event that cell resistances (for example: ohmic, diffusional, over-potential) are such that the potential generated in the first cell is not sufficient, then additional electrical potential can be supplied from an external power source (not shown) by connecting it in series with the electronic circuit of the cells. External power may also be usefully applied to increase the rates of reactions in the cells.

Although the present invention has been described in terms of specific embodiments, it is not so limited. Suitable alterations and modifications for operation under specific conditions will be apparent to those skilled in the art. Such modifications that may be obvious to one of skill in the art include, but are not limited to, the use of more than three electrochemical cells as shown as well as providing additional external power as required to maintain the energy required for reactions and/or improve the system performance. It is therefore intended that the following claims be interpreted as covering all such alterations and modifications as fall within the true spirit and scope of the invention.

What is claimed is:

1. A process for recovering sulfur and generating hydrogen from a feedstream comprised of an aqueous solution of a metal sulfide, which process comprises:

a) providing at least a first electrochemical cell, a second electrochemical cell, and a third electrochemical cell, all connected in series;

b) dividing the feedstream into at least three fractions;

c) introducing a first fraction of said feedstream into said first electrochemical cell along with an effective amount of water and an effective amount of oxygen resulting in the generation of elemental sulfur and a metal hydroxide, and generating a first electrical potential across said first electrochemical cell;

d) removing at least a portion of said elemental sulfur and said metal hydroxide from said first electrochemical cell;

e) passing electrons from the anode of said first electrochemical cell to the cathode of said second electrochemical cell to generate a second electrical potential across said second electrochemical cell;

f) introducing a second fraction of said feedstream to said second electrochemical cell along with an effective amount of water resulting in the generation of elemental sulfur, a metal hydroxide, and hydrogen;

g) removing at least a portion of said elemental sulfur and said metal hydroxide and hydrogen from said second electrochemical cell;

h) passing electrons from the anode of said second electrochemical cell to the cathode of said third electrochemical cell to generate a third electrical potential across said third electrochemical cell;

i) introducing a third fraction of said feedstream into said third electrochemical cell along with an effective amount of water resulting in the generation of elemental sulfur, a metal hydroxide, and hydrogen;

j) removing at least a portion of said elemental sulfur, said metal hydroxide, and hydrogen from said third electrochemical cell; and k) passing electrons from the anode of said third electrochemical cell to the cathode of at least one other electrochemical cell;

wherein an electrical circuit around all of the electrochemical cells is completed with the first electrochemical cell.

2. The process of claim 1, wherein the metal hydroxide is selected from an alkali hydroxide, an alkaline-earth metal hydroxide, or a combination thereof.

3. The process of claim 1, wherein the metal hydroxide is comprised of an alkali metal hydroxide.

4. The process of claim 3, wherein the alkali metal hydroxide is selected from sodium hydroxide and potassium hydroxide.

5. The process of claim 1, wherein the three fractions are substantially equal fractions.

6. The process of claim 1, wherein the three electrochemical cells are divided cells comprised of a cation permeable membrane.

7. The process of claim 6, wherein the cation permeable membrane is comprised of hydrocarbon and halocarbon polymers containing functional groups selected from the group consisting of acid groups and acid derivation groups.

8. The process of claim 7, wherein the polymer is a perhalocarbon polymer containing groups selected from the group consisting of sulfonic, sulfoamide and carboxylic acid groups.

9. The process of claim 1, wherein the first electrical potential generated is from about 0.5 to about 5.0 volts.

10. The process of claim 1, wherein the at least one other electrochemical cell of step k) is said first electrochemical cell.

11. A process for desulfurizing a sulfur-containing heavy-oil feedstock comprising:

a) contacting said heavy-oil feedstock with an aqueous metal hydroxide solution wherein the metal is selected from the alkali metals and the alkaline-earth metals, thereby converting at least a portion of the metal hydroxides into metal sulfides;

b) separating the mixture from step a) into a desulfurized heavy-oil product and an aqueous metal sulfide-containing stream wherein the desulfurized heavy-oil product has a lower sulfur content by wt % than said heavy-oil feedstock;

c) providing at least a first electrochemical cell, a second electrochemical cell, and a third electrochemical cell, all connected in series;

d) dividing the aqueous metal sulfide-containing stream into at least three fractions;

e) introducing a first fraction of said aqueous metal sulfide-containing stream into said first electrochemical cell along with an effective amount of water and an effective amount of oxygen resulting in the generation of elemental sulfur and a metal hydroxide, and generating a first electrical potential across said first electrochemical cell;

f) removing at least a portion of said elemental sulfur and said metal hydroxide from said first electrochemical cell;

g) passing electrons from the anode of said first electrochemical cell to the cathode of said second electrochemical cell to generate a second electrical potential across said second electrochemical cell;

h) introducing a second fraction of said aqueous metal sulfide-containing stream to said second electrochemical cell along with an effective amount of water resulting in the generation of elemental sulfur, a metal hydroxide, and hydrogen;

i) removing at least a portion of said elemental sulfur and said metal hydroxide and hydrogen from said second electrochemical cell;

j) passing electrons from the anode of said second electrochemical cell to the cathode of said third electrochemical cell to generate a third electrical potential across said third electrochemical cell;

k) introducing a third fraction of said aqueous metal sulfide-containing stream into said third electrochemical cell along with an effective amount of water resulting in the generation of elemental sulfur, a metal hydroxide, and hydrogen;

l) removing at least a portion of said elemental sulfur, said metal hydroxide, and hydrogen from said third electrochemical cell; and m) passing electrons from the anode of said third electrochemical cell to the cathode of at least one other electrochemical cell;

wherein an electrical circuit around all of the electrochemical cells is completed with the first electrochemical cell.

12. The process of claim 11, wherein the heavy oil feedstock is comprised of a bitumen.

13. The process of claim 11, wherein the heavy oil feedstock has a sulfur content of at least 3 wt %.

14. The process of claim 11, wherein the heavy-oil feedstock is contacted with the aqueous metal hydroxide solution in step a) at a temperature of about 150° F. to about 500° F. under a pressure of about 15 psia to about 800 psia.

15. The process of claim 11, wherein the metal hydroxide is selected from an alkali hydroxide, an alkaline-earth metal hydroxide, or a combination thereof.

16. The process of claim 11, wherein the metal hydroxide is comprised of an alkali metal hydroxide.

17. The process of claim 16, wherein the alkali metal hydroxide is selected from sodium hydroxide and potassium hydroxide.

18. The process of claim 11, wherein the three electrochemical cells are divided cells comprised of a cation permeable membrane.

19. The process of claim 18, wherein the cation permeable membrane is comprised of hydrocarbon and halocarbon polymers containing functional groups selected from the group consisting of acid groups and acid derivation groups.

20. The process of claim 19, wherein the polymer is a perhalocarbon polymer containing groups selected from the group consisting of sulfonic, sulfoamide and carboxylic acid groups.

21. The process of claim 11, wherein the first electrical potential generated is from about 0.5 to about 5.0 volts.

22. The process of claim 11, wherein the at least one other electrochemical cell of step m) is said first electrochemical cell.

23. The process of claim 11, wherein the at least a portion of the metal hydroxide generated in at least one of the electrochemical cells is recycled and contacted with the heavy oil feedstock in step a).

* * * * *